United States Patent [19]

Schumacher

[11] 4,015,442

[45] Apr. 5, 1977

[54] HOUSEHOLD REFRIGERATOR HAVING A DOOR COOLING APPARATUS

[75] Inventor: Frank A. Schumacher, Louisville, Ky.

[73] Assignee: General Electric Company, Louisville, Ky.

[22] Filed: June 5, 1975

[21] Appl. No.: 583,919

[52] U.S. Cl. ..... 62/449

[51] Int. Cl.[2] ..... F25D 19/00

[58] Field of Search ..... 62/265, 449, 267

[56] References Cited

UNITED STATES PATENTS

| | | | |
|---|---|---|---|
| 2,401,460 | 6/1946 | Charland | 62/449 |
| 2,604,760 | 7/1952 | Southern | 62/267 |
| 2,607,204 | 8/1952 | Kleist | 62/265 |
| 2,721,454 | 10/1955 | Levey | 62/449 |
| 2,964,912 | 12/1960 | Roeder, Jr. | 62/449 |

*Primary Examiner*—Lloyd L. King

*Attorney, Agent, or Firm*—Steven C. Schnedler; Francis H. Boos

[57] ABSTRACT

A household refrigerator having a door and a cooling compartment has a heat exchange transfer medium circulatory system associated with the door. The circulatory system has a probe extending into the cooling compartment in the closed position of the door and a serpentine portion positioned within the door and extending along an inner wall of the door. The circulatory system is a closed system that is movable with the door and contains a heat transfer medium for cooling the door.

4 Claims, 4 Drawing Figures

HOUSEHOLD REFRIGERATOR HAVING A DOOR COOLING APPARATUS

BACKGROUND OF THE INVENTION

In the construction of household refrigerators, there has been a continuing problem of reducing the amount of heat transferred through the relatively large refrigerator door and into the cooling compartment while maintaining a small door thickness.

It is known that heat pipes are useful in heating and cooling selected portions of a refrigerator, as taught by U.S. Pat. No. 2,537,314-Mortensen, which shows a heat pipe absorbing heat from the freezing compartment and dissipating the heat in a machinery compartment.

However, to provide a heat pipe system that would cool the door of a refrigerator presented a problem of how to construct the heat pipe system to provide for repeated opening and closing of the refrigerator door. Problems of lowered cooling efficiency and sweating of the apparatus are caused if the apparatus is constructed to pass from the cooling compartment into the door via a door hinge. A flexible connection coupling the heat pipe in the door with a heat pipe in the compartment was considered, but this construction was decided to be less durable than desired and would detrimentally affect the esthetic appearance of the refrigerator.

The construction of the door-cooling apparatus of this invention provides desirable cooling of the door while avoiding the problems of the previously considered structures.

DETAILED DESCRIPTION OF THE INVENTION

Figure 1:
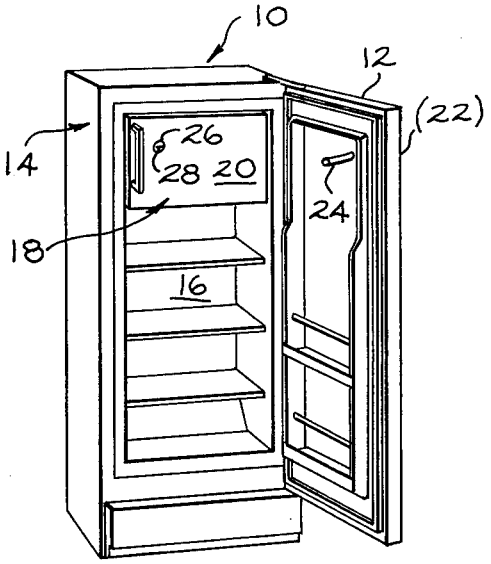
FIG. 1 is a perspective view of a household refrigerator having the apparatus of this invention.

In the embodiment of FIG. 1, a household refrigerator 10 has a refrigerator door 12 pivotally connected to the refrigerator cabinet 14 for gaining access to fresh food and freezing compartments 16, 18 of the refrigerator 10. The freezing compartment 18 has a freezing compartment door 20. A heat pipe system 22, constructed in accordance with the present invention, is located in the door, preferably on or close to the inner surface of the door.

Figure 2:
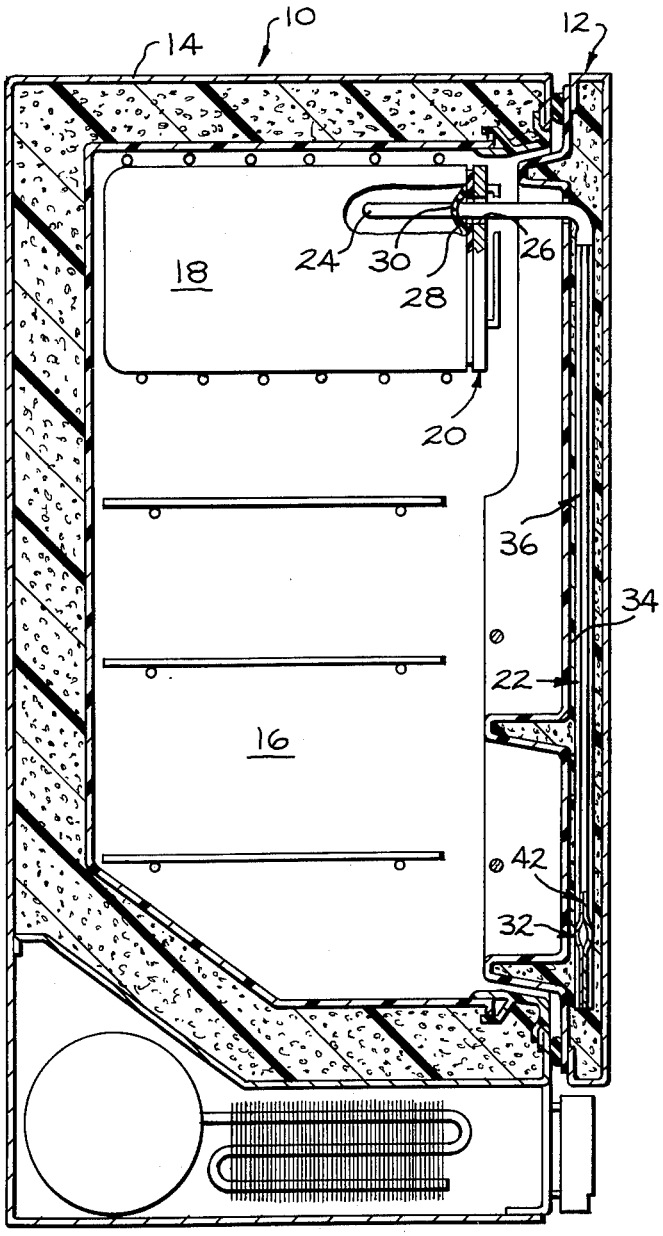
FIG. 2 is a diagrammatic side view in partial section of the refrigerator of FIG. 1.

Referring to FIG. 2, the circulatory system 22 has a probe 24 that extends outwardly from the door 12 and into the cabinet 14 in the closed position of the door 12. The probe 24 preferably extends through an opening 26 in the freezing compartment door 20 and into the interior of the freezing compartment 18.

Figure 4:
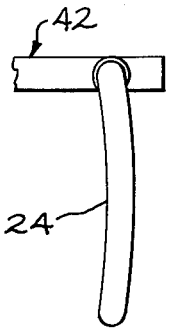
FIG. 4 is an enlarged top view of the probe.

As better seen in FIG. 4, the probe 24 is preferably of a curvilinear configuration for maintaining the opening 26 as small as possible. The probe 24 is of a curvature defined by the arcuate pathway of the probe 24 moving in response to the pivotal movement of the refrigerator door 12.

As shown in FIG. 2, a deflectable sealing element 28 is attached to the freezer door 20 at a location adjacent the opening 26. The sealing element 28 extends over the opening 26 in the absence of the probe 24 for sealing the fresh food compartment 16. The deflectable sealing element 28 has one or more slits 30 formed therethrough for the passage of the probe 24 through the element 28 and sealing the annulus formed between the probe 24 and the freezer door 20 in the inserted position of the probe 24. The sealing element 28 can be formed of rubber, for example.

Figure 3:
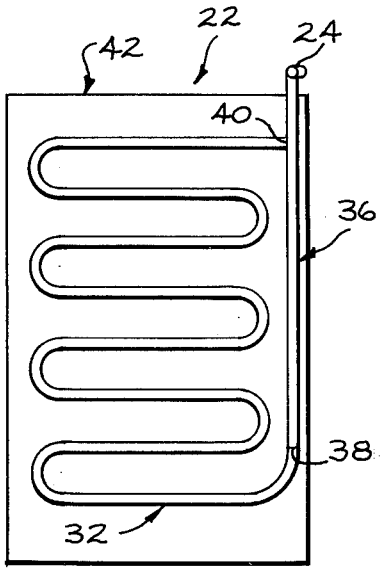
FIG. 3 is a diagrammatic frontal view of the apparatus of this invention.

Referring to FIGS. 2 and 3, the circulatory system 22 has a serpentine cooling portion 32 fixedly positioned within the refrigerator door 12. The cooling portion 32 extends in heat exchange relationship along an inner wall 34 of the door 12. The circulatory system 22 is a closed system having a heat transfer medium such as, for example, refrigerant $R_{11}$ or $R_{12}$.

In a preferred embodiment of the system 22, as shown in FIG. 3, the probe 24 is at a higher elevation than the serpentine portion 32. In the installed position of this construction, a portion 36 of the circulatory system 22 extends substantially vertically downwardly from the probe 24. The serpentine portion 32 is connected at its opposed ends 38, 40 to the generally vertically-positioned portion 36 and in fluid communication therewith for forming a loop with the vertical portion 36 of the system 22.

In order to improve the heat exchange efficiency of the circulatory system 22, a heat-conducting element 42 extends outwardly from the serpentine portion 32. This heat-conducting element 42 can be a separate element or be unitary with the serpentine portion 32, as shown in FIG. 2. The heat conducting element 42 can be formed of metal such as aluminum, for example.

A guard (not shown) can be positioned in the freezing compartment 18 for receiving the probe 24 and preventing frozen food items in the freezing compartment from interferring with insertion of the probe 24 into said compartment.

Once the heat transfer through the door of a particular refrigerator construction is known, one skilled in thermodynamics can readily calculate the dimensions of the apparatus for maintaining the inner wall of the door at a preselected temperature value.

In the operation of the apparatus of this invention, the probe 24 is cooled in the freezing compartment 18 in the closed position of the refrigerator door 12. As the heat transfer medium in the probe 24 cools, it condenses and the resultant liquid travels by gravity from the probe 24 downwardly through the vertical portion 36 and into the lower end of the serpentine portion 32. Heat passing through the door 12 is absorbed by the cooling medium in the serpentine portion 32 and functions to cool the door 12.

As the medium in the serpentine portion 32 becomes warmer, it is vaporized by the conducted heat and passes as vapor from the serpentine portion 32, through an upper portion of the vertical portion 36 and returns to the probe 24 for condensing.

When a user opens and closes the refrigerator door 12, the probe 24 moves from and into the freezing compartment 18 in response to movement of the refrigerator door 12. By this construction, the heretoforementioned problem is avoided. The door-cooling system of this invention is of simple construction and operates efficiently to cool the door.

Other modifications and alterations of this invention will become apparent to those skilled in the art from the foregoing discussion, and it should be understood that this invention is not to be unduly limited thereto.

What is claimed is:

1. In a household refrigerator having an outer door, a freezing compartment, and a freezing compartment door, door cooling apparatus comprising:

a closed heat pipe system including a generally elongate probe and a cooling portion, and containing a heat transfer medium;

the freezing compartment door having an opening therein for receiving said probe, and a deflectable sealing element attached adjacent the opening, said sealing element being constructed to seal the annulus between said probe and the freezer door opening in the presence of said probe and to seal the freezer door opening in the absence of said probe;

said probe extending outwardly from the interior of the outer door generally perpendicular thereto and being of curvilinear configuration with the curvature determined by the arcuate pathway followed by said probe in response to pivotal movement of the outer door, said probe being positioned so as to extend past said deflectable sealing element and through said opening into the interior of said freezing compartment when the outer door is in the closed position; and said cooling portion being connected to the door and extending along an inner wall of the door.

2. Apparatus, as set forth in claim 1, wherein the probe is at a higher elevation than the cooling portion.

3. Apparatus, as set forth in claim 2, wherein a portion of the heat pipe system extends substantially vertically downwardly from the probe and a serpentine portion is connected at its opposed ends to the generally vertically-positioned portion of the system for forming a loop.

4. Apparatus, as set forth in claim 1, including a heat-conducting element extending outwardly from the cooling portion.

* * * * *